US008499380B2

(12) United States Patent
Grace

(10) Patent No.: US 8,499,380 B2
(45) Date of Patent: Aug. 6, 2013

(54) PORTABLE AND COLLAPSIBLE COT STRUCTURE

(75) Inventor: Daniel R. Grace, Old Saybrook, CT (US)

(73) Assignee: Integrity Outdoor Brands LLC, Higganum, CT (US)

( * ) Notice: Subject to any disclaimer, the term of this patent is extended or adjusted under 35 U.S.C. 154(b) by 22 days.

(21) Appl. No.: 13/221,096

(22) Filed: Aug. 30, 2011

(65) Prior Publication Data

US 2012/0047649 A1 Mar. 1, 2012

Related U.S. Application Data

(60) Provisional application No. 61/378,105, filed on Aug. 30, 2010.

(51) Int. Cl.
*A47C 17/00* (2006.01)
*A47C 19/00* (2006.01)

(52) U.S. Cl.
USPC ..... 5/110; 5/114

(58) Field of Classification Search
USPC ..... 5/110–117, 625–627; 108/116, 108/118, 119, 120; 403/100–102
See application file for complete search history.

(56) References Cited

U.S. PATENT DOCUMENTS

| | | | | |
|---|---|---|---|---|
| 228,920 | A | 6/1880 | Murray et al. | |
| 540,041 | A | 5/1895 | Blomberg | |
| 600,647 | A * | 3/1898 | Niemeyer | 5/114 |
| 1,159,746 | A * | 11/1915 | Clark | 296/20 |
| 1,281,385 | A * | 10/1918 | Johnson | 5/625 |
| 1,608,924 | A * | 11/1926 | Brown | 108/118 |
| 1,696,245 | A | 12/1928 | Manly | |
| 2,591,551 | A * | 4/1952 | Kaplan | 5/110 |
| 2,866,208 | A | 12/1958 | Vanderminden | |
| 3,839,754 | A * | 10/1974 | Hooper | 5/98.2 |
| 6,618,879 | B1 * | 9/2003 | Wu | 5/111 |
| 2010/0205737 | A1 * | 8/2010 | Peterson | 5/111 |
| 2010/0235987 | A1 * | 9/2010 | So | 5/112 |
| 2011/0000017 | A1 | 1/2011 | Peterson | |
| 2011/0023232 | A1 * | 2/2011 | Sun | 5/111 |

FOREIGN PATENT DOCUMENTS

CN 201048738 Y 4/2008

* cited by examiner

*Primary Examiner* — William Kelleher
*Assistant Examiner* — Richard G Davis
(74) *Attorney, Agent, or Firm* — McCormick, Paulding & Huber LLP

(57) ABSTRACT

A portable and collapsible cot structure comprises a fabric web, a frame, and a plurality of folding legs pivotally attached to the frame. The cot structure is collapsible to a bundled condition to minimize the amount of space taken up by the structure during storage and transportation. The cot structure includes at least one locking assembly pivotally connected to a leg assembly for maintaining the cot in an open, set-up condition, wherein the locking assembly must be unlocked before the cot structure can be collapsed. The locking assembly includes a first pedal for locking the assembly and a second pedal for unlocking the assembly. Preferably, a downward force can be applied to operate either pedal, thereby facilitating quick and easy set-up and break down of the cot structure without compromising safety, consuming too much time, or requiring undue effort.

18 Claims, 7 Drawing Sheets

PORTABLE AND COLLAPSIBLE COT STRUCTURE

CROSS-REFERENCE TO RELATED APPLICATION

This application claims the benefit of U.S. Provisional Application No. 61/378,105, filed Aug. 30, 2010, which is incorporated herein by reference.

FIELD OF THE INVENTION

The present invention relates in general to collapsible articles of furniture and more particularly to a collapsible and portable cot structure.

BACKGROUND OF THE INVENTION

The present invention is concerned with improvements in collapsible and portable furniture of simple, durable, quality construction which may be easily and quickly set up, and similarly, quickly and easily collapsed to minimal size to satisfy the needs of the average user, including campers, charities, emergency personnel, and the like. In particular, the present invention is directed to a collapsible and portable cot structure that can quickly and easily be set-up for use, and quickly and easily broken down to a compact bundle for convenient transport and storage.

A collapsible and portable cot structure, commonly known as a military cot, is well known in the art. The military cot is ideal for transient uses, such as for camping, temporary accommodations, and military uses, because it is generally made of light-weight material for easy transportation, and can be broken down, transported, stored and set-up as needed. Such cots have also been traditionally used in situations where numerous cots are needed in one place, such as for disaster relief efforts, and further where numerous cots are needed to be quickly set-up to accommodate large crowds of people.

Common portable cot designs generally comprise a frame supported by a plurality of folding legs pivotally mounted thereunder. When stored, the legs and frame are folded to a bundled condition. To use the cot, the user must set up the cot by unfolding the frame and the legs. Once set up, the user lays on a piece of fabric provided on the frame that is generally held taut by the frame once the frame and legs have been fully unfolded. Prior art military cot designs generally include end rails forming part of the set-up frame that are separated from the frame when the cot is broken down. During set-up, the end rails are slid through sleeves in the fabric and locked into place on side rails defining the footprint of the frame. In order to break down the cot, the end rails must be disengaged from the side rails before the cot can be collapsed. It is often very difficult to lock the end rails into place for proper set-up of the cot, and it is often similarly difficult to disengage the end rails from the side rails to break down the cot after use, especially since the end rails are typically keeping the cot fabric taut, and increased counterforce is required to overcome the tautness of the fabric to disengage the end rails. Quick and easy set-up and break down of collapsible and portable cots is highly desired, especially in disaster relief situations. In such situations, however, cots are often set-up by volunteers who commonly are senior citizens, and set-up and breakdown of prior art military cots have proven too difficult and time consuming.

The removable end rails of the prior art military cot design have also posed problems during storage of such collapsible and portable cots. As noted, the end rails must be disengaged and removed from the side rails in order to break down the cot. After the cot has been folded into a bundle, the end rails must be stored with the bundled cot. In disaster relief efforts, one may need to account for hundreds or thousands of cots, and the end rails often get separated from the bundled cots and occasionally lost. Set-up of the cots may be consequently delayed when a bundle does not include the end rails. Moreover, if the cots are set-up without the end rails, the cots are not safe, since the rigid end rails act as a means to maintain the cot in a set-up condition, especially when the user's weight presses down on the fabric. Without the end rails, an adequate means of locking the frame in a set-up condition is required to prevent the cot from buckling or collapsing during use and heretofore, no such means have been developed for a military cot.

Additionally, the rigid end rails of the prior art military cot design can also increase discomfort during use of the cot, especially where a user may have to rest his or her head and/or legs directly on an end rail.

In view of the foregoing, there is a need for a new and improved portable and collapsible cot structure that overcomes the problems and drawbacks associated with prior art collapsible cots. Accordingly, it is a general object of the present invention to provide a cot structure designed to be collapsed into a minimally-sized bundle for convenient transport and storage, but which can also be quickly and easily set-up without compromising safety, consuming too much time, or requiring undue effort.

SUMMARY OF THE INVENTION

In accordance with an embodiment of the present invention, there is provided a collapsible cot structure comprising a fabric web, a frame, and a plurality of folding legs pivotally attached to the frame. As set up, the cot structure provides support for a person to lie down or sit on top of the fabric, which is supported by the frame and the folding legs. The fabric web, the frame and the folding legs are collapsible into a collective bundled condition where all of the frame members and legs are generally parallelly disposed so as to minimize the amount of space taken up by the collapsed cot structure. As so bundled, all of the parts of the cot structure are kept together. Preferably, the bundled cot can be stored in a travel bag for transport or storage.

In a first aspect of the present invention, the frame of the cot structure includes a pair of rail members. The fabric web is provided on the frame and extends between the rail members thereof. Each of the leg assemblies are pivotally connected to the frame, and comprise a first leg and a second leg pivotally connected together and being movable between an open condition and a closed condition, wherein the first and second legs are disposed in a generally X-shaped relationship in the open condition and the first and second legs are disposed in a generally parallel relationship in the closed condition. The cot structure further includes a locking assembly pivotally mounted to at least one leg assembly for locking the cot in an open condition, wherein the open condition of the leg assemblies is associated with the open condition of the cot such that the rail members of the frame are spaced apart from one another and the fabric is generally taut when the leg assemblies are in the open condition. When the leg assemblies are in the closed condition, the rail members of the frame are generally abutting one another and the fabric web is generally relaxed.

In preferred designs of the locking assembly, the assembly includes a first portion pivotally connected to the first leg of the leg assembly and a second portion pivotally connected to the second leg of the leg assembly, wherein the first and second portion are further pivotally connected to one another and moveable between a locked condition and an unlocked condition.

In an embodiment of the locking assembly, a first pedal and a second pedal are provided, wherein force on the first pedal—e.g., by one's foot or hand—moves the locking assembly to its locked condition, and a force on the second pedal in the opposite direction unlocks the locking assembly.

In another embodiment of the locking assembly, the first portion of the locking assembly may further include an extension formed on an end thereof outwardly extending from the pivotal connection point between the first portion and the first leg, wherein the first pedal is provided on the extension, giving the user better access to the locking assembly. The second pedal may further be mounted on the first portion of the locking assembly on the inward end thereof at a position proximate the pivotal connection point between the first portion and the second portion of the locking assembly—e.g., at a position between the legs of the folding leg assembly.

In another aspect of the present invention, an anti-sag anchor system is provided to prevent sagging of the fabric in the set-up condition of the cot structure, especially when weight is applied to the fabric—e.g., from a person laying down or sitting on the cot. The anchor system also helps longitudinally center the fabric in its set-up condition, and prevents shifting of the fabric towards one end or the other when a weight is applied to the fabric—e.g., from a person laying down or sitting on the cot.

In an embodiment of the cot structure of the present invention, the cot comprises a frame including a pair of rail members supported by a plurality of leg assemblies, a fabric web provided on the frame and extending between the rail members thereof, and an anchor assembly connecting the fabric web to the frame for restricting sag of the fabric between the rail members. The anchor assembly comprises an anchor bracket attached to each rail member and fabric strips attached to the fabric that connect to a respective anchor bracket for connecting the fabric to the frame of the cot structure. In a preferred embodiment of the anchor assembly, the fabric strips are positioned on each side of the fabric at the longitudinal center of the web. The fabric can further include end loops to be positioned around the ends of the frame rail members to increase tautness of the fabric web at its longitudinal ends.

These and other objects, features and advantages of the present invention will become apparent in light of the detailed description of embodiments thereof, as illustrated in the accompanying drawings.

DESCRIPTION OF PREFERRED EMBODIMENTS

Figure 1:
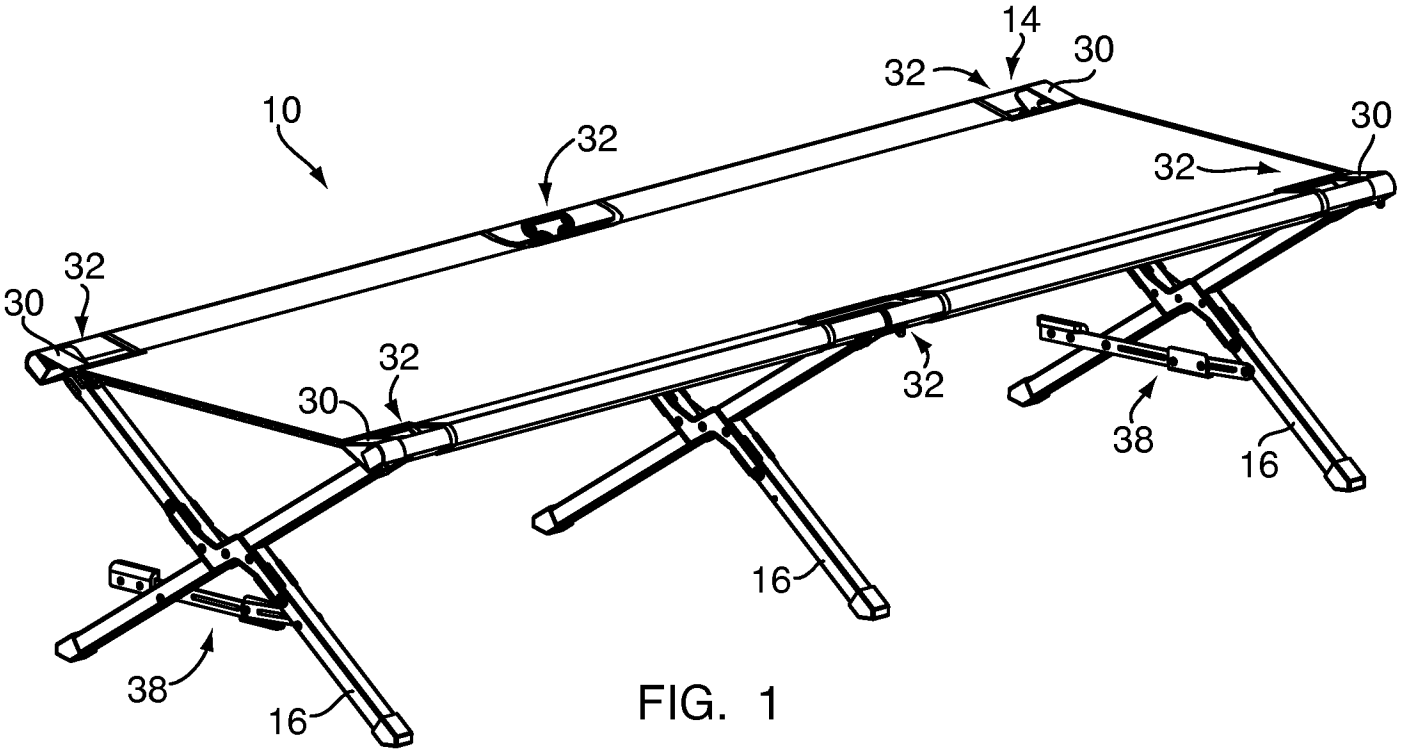
FIG. 1 is a perspective view of a set-up cot structure embodying the present invention.

In the drawings and in the description that follows, the present invention is illustrated and described with reference to a portable and collapsible cot structure embodying the present invention.

Turning now to the drawings and referring first particularly to FIG. 1, a collapsible multi-legged cot structure embodying the present invention is designated generally by the reference number 10. The illustrated cot 10 essentially comprises a collapsible supporting structure including a fabric web 12, a frame 14 and a plurality of leg assemblies 16. As shown, there are three leg assemblies 16 supporting the frame 14, each of a cross-legged type, though more or fewer leg assemblies may be used depending on the size of the cot 10. In particular, one leg assembly 16 is provided at each end of the frame 14, and a third leg assembly 16 is provided in the center of the frame 14. As further shown in FIG. 2, the frame 14 comprises two generally parallel rail members 18, each of which is hinged in the center for folding the rail members 18 to a smaller dimension for storage and transportation.

Figure 2:
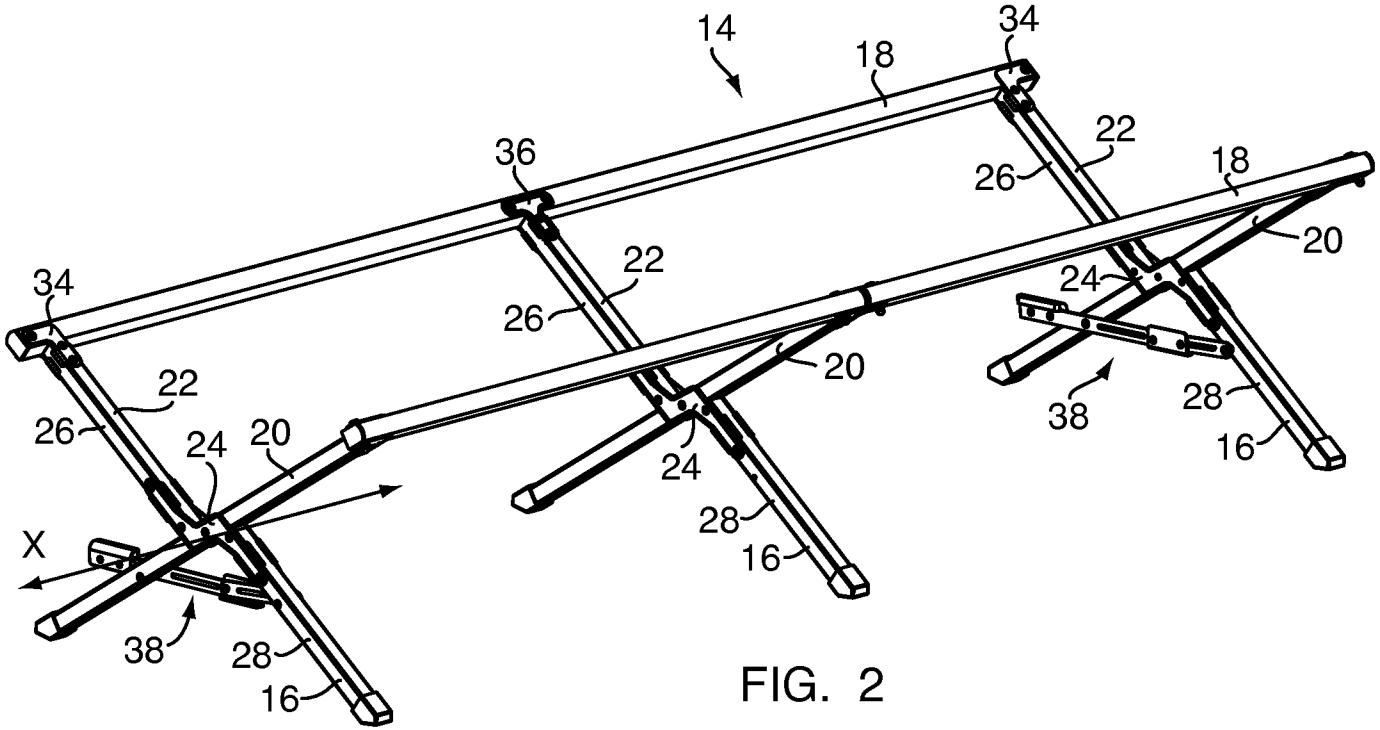
FIG. 2 is a partial perspective view of the cot structure of FIG. 1 without the fabric web, and illustrating the frame and folding leg assemblies in accordance with a preferred embodiment of the present invention.
Figure 3:
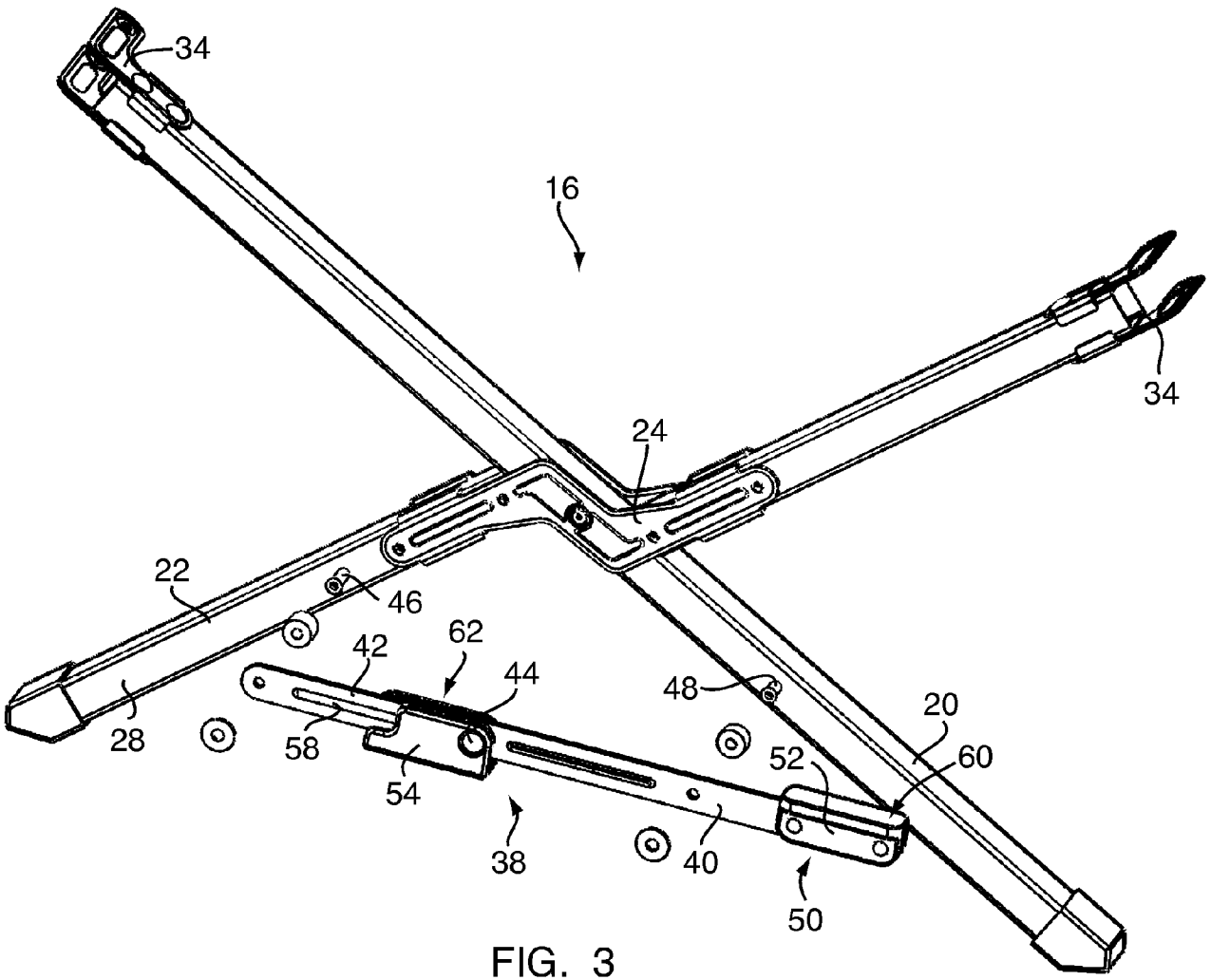
FIG. 3 is an exploded end view of a folding leg assembly used in the cot structure of FIG. 1 in a set-up condition, with a locking assembly in a locked condition.
Figure 4:
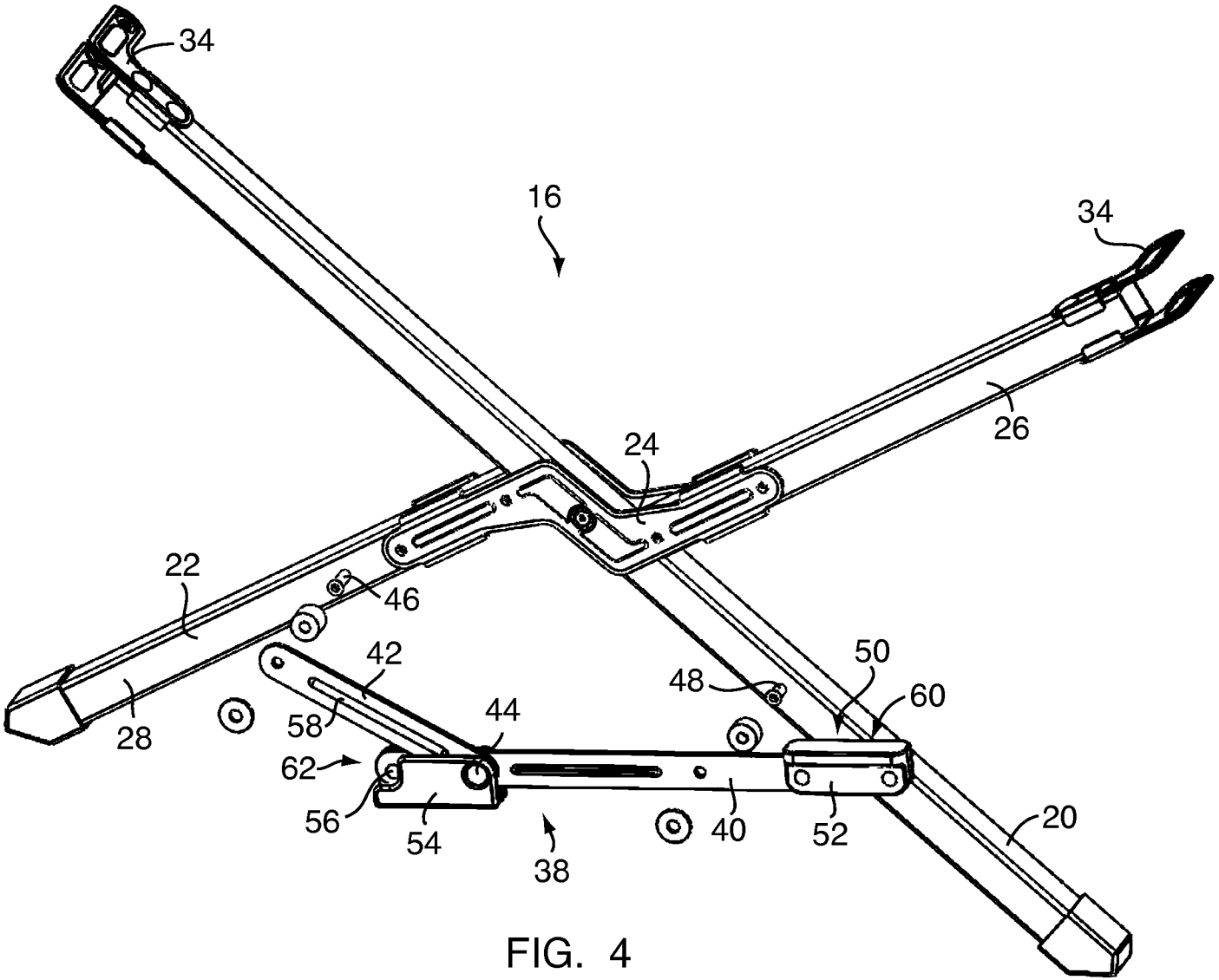
FIG. 4 is an exploded end view of the folding leg assembly of FIG. 3 in a set-up condition, but with the locking assembly in an unlocked condition.
Figure 6:
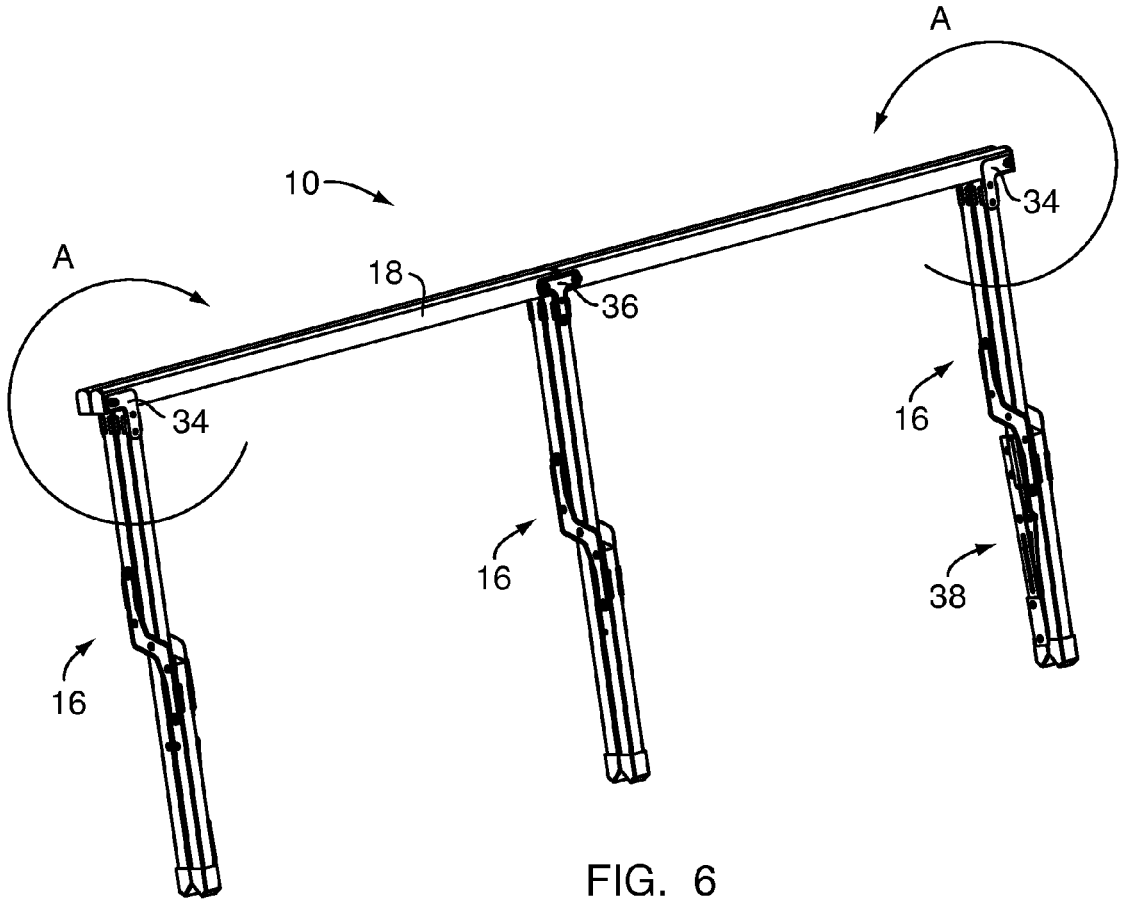
FIG. 6 is a partial perspective view of the cot structure of FIG. 2, illustrating a first folding step.

As shown more particularly in FIGS. 2-4, each leg assembly 16 includes collapsible first and second legs, indicated generally at 20 and 22, and centrally connected, each to the other, by a common central linkage assembly 24 for limited angular movement about a pivot axis X relative to each other between open and closed conditions. In FIGS. 2-4, the legs are shown in a generally X-shaped open, or set-up, condition. In FIG. 6, the legs are shown in a closed condition, where the first and second legs 20 and 22 are generally parallel to each other. The illustrated leg assemblies 16 are merely preferred designs for the cot structure in accordance with the present invention. Alternative designs of leg assemblies can be used on the cot structure 10 without departing from the spirit and principles of the present invention, including, for example, the leg assemblies described in published U.S. Patent Application Nos. 2007/0228780 and 2009/0102248, which are incorporated herein by reference.

In a preferred design of the leg assemblies 16 for the present invention, as shown, the first leg 20 is a continuous leg, while the second leg 22 is broken into an upper section 26 and a lower section 28. The first continuous leg 20 is pivotally connected to the common central linkage assembly 24, which takes the form of a pivot bracket. The upper and lower sections 26 and 28 of the second leg 22 are fixedly secured to the pivot bracket 24 in a longitudinally offset relationship to one another. In the open, set-up condition of the leg assembly 16, the first continuous leg 20 pivots relative to the second leg 22 until it is restrained from movement, for example, by the tautness of the fabric (if properly sized), a locking assembly (as discussed in more detail below), or by contact between the first leg 20 with the upper and lower sections 26 and 28 of the second leg 22. In this open condition, the first and second legs 20 and 22 generally form an X-shape.

When each leg assembly 16 is collapsed to the closed condition, the upper and lower sections 26 and 28 of the second leg 22 pivot relative to the first continuous leg 20 about axis X by means of the pivot bracket 24 so that the legs are disposed in a generally parallel relationship, with the upper section 26 of the second leg 22 abutting one side of the first leg 20 and the lower section 28 of the second leg 22 abutting the other side of the first leg 20, as shown in FIG. 6. In a first step of collapsing the cot structure 10 of the present invention, the leg assemblies 16 are collapsed to a closed condition, which causes the frame rail members 18 to move towards each other until they generally abut one another.

In FIG. 6, the fabric web 12 is removed for illustration purposes only. During ordinary break down of the cot structure 10, the fabric web 12 will relax and fold within the frame rail members 18 and leg assemblies 16 so as to be bundled therewith. Referring to FIG. 1, the fabric web 12 is provided with end loops 30 that are positioned at and around the ends of the frame rail members 18. When the cot 10 is set up, the end loops 30 make the lateral ends of the fabric web 12 taut in order to provide adequate support for the user's head and legs without being too uncomfortable. Indeed, in accordance with the present invention, the tautness of the fabric 12 at the ends provide a cot structure that does not need rigid end rails, as are common in prior art military cot designs to prevent collapse. Unlike such rigid end rails of the prior art, the fabric 12, while preferably taut when stretched on the frame 14 between the side rail members 18, continues to be flexible and able to stretch to accommodate the weight of a user so as to improve the comfort of the cot structure 10 for a user lying or sitting on top of the fabric 12 in comparison with prior art military cot designs.

In order to break down the cot 10, the end loops 30 slide off of the ends of the frame rail members 18. First, this relaxes the fabric web 12. Second, this exposes the outer leg assemblies 16 for collapsing of the cot 10 as described below. In preferred designs of the present invention, the end loops 30 are automatically removed from the ends of the frame rail members 18 by the act of rotating the collapsed outer leg assemblies 16 relative to the frame rail members 18, as described in more detail below, though a user can easily manually slip the end loops 30 off of the rail members 18 as well. As shown in FIG. 1, the fabric web 12 further includes cut-outs 32 around its perimeter so as not to interfere with the joints between the frame 14 and the leg assemblies 16.

As shown in FIG. 2, the outer leg assemblies 16 are connected to the ends of the frame 14 by generally L-shaped elbow brackets 34. Preferably, an L-bracket 34 is provided on each of the top and bottom surface of the upper portion of the leg 20 or 22, as shown in FIG. 3, as attached to the inside and outside surfaces of the rail members 18, to improve the connection of the end leg assemblies 16 to the frame 14. The elbow brackets 34 are mounted in "reverse" position and are pivotally connected on one end to the frame 14 at a position located proximate the end of the frame rail members 18. The other end of each elbow bracket 34 is rigidly secured to the upper end of a leg 20 or 22. When collapsing the cot structure 10, the elbow brackets 34, and thus the leg assemblies 16, rotate outward and over the top of the frame 14 along the general paths indicated by arrows A in FIG. 7. The outer leg assemblies 16 end up in generally parallel relation to the frame rail members 18.

Figure 7:
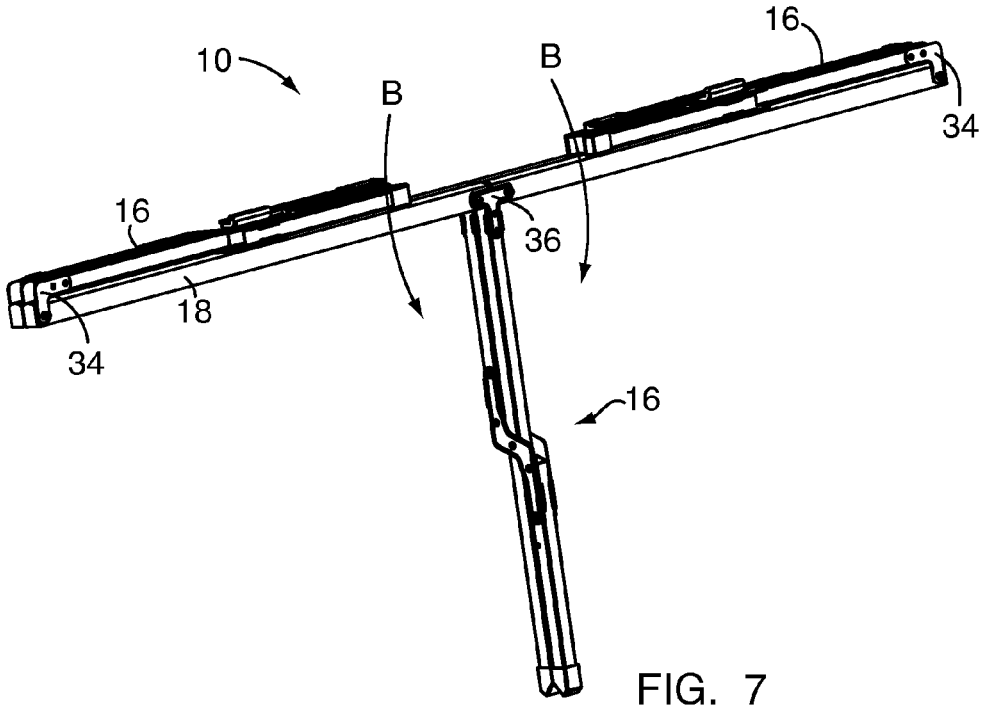
FIG. 7 is a partial perspective view of the cot structure of FIG. 2, illustrating a second folding step.
Figure 8:
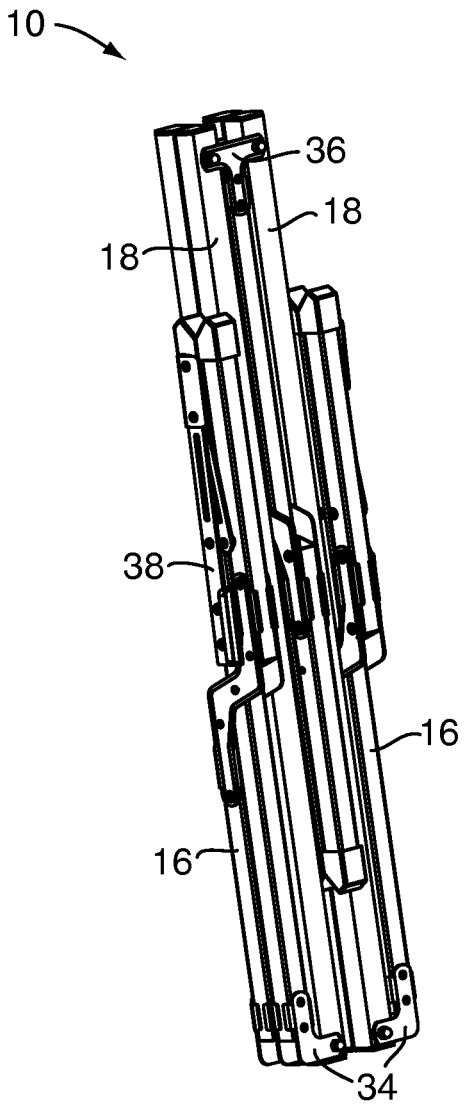
FIG. 8 is a partial perspective view of the cot structure of FIG. 2, illustrating a third folding step, wherein the cot structure is in a fully collapsed condition.

As shown in FIG. 7, the central leg assembly 16 is connected to the frame by a generally T-shaped bracket 36. The leg assembly 16 is rigidly secured to the base of the T-shaped bracket 36, while the inner portions of the frame rail members 18 are pivotally connected to the top of the T-shaped bracket 36. Preferably, a T-bracket 36 is provided on each of the top and bottom surface of the upper portion of the leg 20 or 22, as attached to the inside and outside surfaces of the rail members 18, to improve the connection of the center leg assembly 16 to the frame 14. When continuing to collapse the cot 10 after the outer leg assemblies 16 have been folded as shown in FIG. 7, the frame rail members 18 are pivoted downwardly along the paths indicated by arrows B to positions generally parallel to and on either side of the central leg assembly 16, as shown in FIG. 8. Indeed, FIG. 8 illustrates the cot structure 10 in its fully collapsed and bundled condition with the frame 14 and leg assemblies 16 being generally disposed in parallel relationship to accommodate a minimal storage space. Again, in FIG. 8, the fabric web 12 is removed for illustration purposes only. During ordinary break down of the cot structure 10, the fabric web 12 will relax and fold within the frame rail members 18 and leg assemblies 16 so as to be bundled therewith.

Since the cot structure 10 of the present invention does not use rigid end rails as provided in conventional military cot designs, the frame 14 of the cot 10 alone cannot maintain the cot 10 in its set-up condition. Moreover, since the elbow brackets 34 and the outer leg assemblies 16 rotate outward and over the top of the frame 14 during break down of the cot structure 10, conventional folding links or locking members found on conventional folding tables or similar collapsible structures cannot be used to increase the stability of the set-up cot structure. Accordingly, the present invention utilizes an innovative locking assembly, generally designated by reference numeral 38, to provide rigid locking means to secure the cot 10 in the set-up condition when the leg assemblies 16 are in the open condition.

Referring to FIGS. 3-4, the locking assembly 38 is connected between the first and second legs 20 and 22 and serves to maintain the leg assembly 16 in its open condition. The locking assembly 38 has a generally over-center design, with first and second portions 40 and 42 being pivotally connected to one another via a central pivot pin 44. The locking assembly 38 is held over-center to lock the cot structure 10 in an open condition, even when a weight is applied to the fabric web 12, by one or more of the tautness of the fabric 12; the opening of the leg assemblies 16 to an X-shaped condition; the use of tensioned steel for the locking assembly 38, the frame 14 and the leg assemblies 16; and a rivet/dimple combination in the design of the locking assembly 38.

As further shown, the second portion 42 of the locking assembly 38 is pivotally connected at its inner end to the first portion 40 via the central pivot pin 44 and at its outer end to the lower section 28 of the second leg 22 via a pivot pin 46. The first portion 40 of the locking assembly 38 is pivotally connected to the first leg 20 via pivot pin 48, but preferably extends outwardly past this pivotal connection point to define an extension 50 having a first pedal 52 for aiding in locking and releasing the locking assembly 38. As shown, the first portion 40 also extends inwardly past the central pivotal connection point. A second pedal 54 is provided on the first portion 40 of the locking assembly 38 proximate to the central pivotal connection point on the inward extension thereof.

As used herein, the term "pedal" indicates a means for assisting a user's movement of the locking assembly 38 between a locked and unlocked condition, shown respectively in FIGS. 3 and 4. In the illustrated design, the pedals 52 and 54 generally act as shrouds positioned around the linkage portions of the locking assembly 38 to protect the user—e.g., from sharp edges or the risk of pinching—while facilitating movement and use of the locking assembly 38.

As shown in FIG. 4, the inward end of the first portion 40 includes a projection or rivet 56 that engages a detent or dimple 58 formed in the second portion 42 for securing the portions 40 and 42 together when the locking assembly 38 is in its locked position. More particularly, the friction caused between the rivet 56 and the dimple 58 prevents the locking assembly 38 from unlocking without a required force being provided by the user to release it. Further, the interaction between the rivet 56 and the dimple 58 facilitates alignment of the portion 40 and 42 to ensure easy use of the locking assembly 38, which generally makes set up and break down of the cot 10 easier.

The first pedal 52 is a generally T-shaped or L-shaped shroud mounted on the end of the extension 50 with a top-facing surface 60 to facilitate use of the pedal 52 by one setting up the cot 10. For example, with a preferred embodiment of the cot 10, the locking assembly 38 is locked by pressing down on the first pedal 52—e.g., by a foot or a hand. The top-facing surface 60 provides an increased surface area that the user can feel and apply weight or force to when using the first pedal 52.

The second pedal 54 comprises a shroud defining an interior channel 62 that receives the second portion 42 of the locking assembly 38 when it is pivoted to a locked condition. The channel 62 also prevents the second portion 42 from pivoting too far relative to the first portion past the desired over-center relationship, regardless of how much force is applied to the first pedal 52. When the locking assembly 38 is locked—i.e., the first portion 40 is moved relative to the second portion 42 so that the rivet 56 engages the dimple 58—the second portion 42 is housed within the channel 62 of the second pedal 54. Preferably, the channel is sufficiently deep so that the second pedal 54 extends above the locking assembly linkages and provides a surface that a user can apply a force to—e.g., by a foot or a hand—to disengage and unlock the locking assembly 38 without risk of pinching oneself between the linkages or the associated leg assembly 16.

The second pedal 54 alternatively comprises a generally L-shaped bracket, with a bottom-facing surface projecting outwardly from the locking assembly 38 between the legs 20 and 22 of the leg assembly 16. In this manner, the second pedal 54 provides a floor to stop movement of the locking assembly 38 into the locked position. That is, as the locking assembly 38 is locked, the inward end of the first portion 40 pivots upwardly relative to the second portion 42. When the second portion 42 abuts the second pedal 54, further pivoting of the portions 40 and 42 is restricted. The bottom-facing surface can also be used to unlock the locking assembly 38, for example, by applying a downward force on the surface.

As preferably designed, the user can use a downward motion to both lock and unlock the locking assembly 38. Moreover, the pedals 52 and 54 permit the user to perform these actions with his or her foot, providing a hands-free locking mechanism reducing risk of pinching oneself in the linkages. The design and use of the locking assembly 38 and the pedals 52 and 54 provides the user with good leverage making the locking assembly 38 easy to disengage or snap into place during set up, eliminates the need for a rigid frame member to lock the cot 10 in an open, set-up condition, allows for quick set-up without being overly strenuous on the user's back, and reduces the risk of the user pinching her or her hands between the legs or locking assembly portions during folding or unfolding actions.

Though preferred operation of the locking assembly 38 involves using a downward force to both lock and unlock the locking assembly 38, as aided by the user's position relative to the cot 10 and gravity, it is readily appreciated by a person of ordinary skill in the art that the force applied to the locking assembly can be an upward force, applied to the pedals 52 and 54, to lock and unlock the locking assembly 38 without departing from the principles and spirit of the present invention.

Since the cot 10 is collapsed from its open, set-up condition for storage and/or transportation, it is convenient to describe an initial collapsing step as a transverse or lateral compression of the leg assemblies 16 and the frame 14. Before performing this initial collapsing step, however, the locking assembly 38 tasked with maintaining the cot 10 in its laterally open condition must first be released. Thereafter, the leg assemblies 16 may be folded and the frame rail members 18 may be moved laterally and in a horizontal direction toward each other, as illustrated in FIG. 6.

As shown in FIG. 2, a locking assembly 38 is preferably provided on each of the outer leg assemblies 16. If desired, a locking assembly 38 can be provided on only one leg assembly, or on any combination of leg assemblies without departing from the principles and spirit of the present invention. For each outer leg assembly 16, the locking assembly 38 is preferably mounted on the inward-facing side so as to be less obtrusive during use of the cot 10 in its open, set-up condition.

Referring now to FIGS. 2 and 6-8, collapsing of the cot structure 12 is illustrated, though the fabric web 12 is not shown for illustration purposes. In FIG. 2, the cot structure 10 is shown in a set-up condition. The user will first disengage the locking assemblies 38 on each of the outer leg assemblies 16 by applying a force to the second pedals 54—e.g., by applying a downward force on each pedal 54 to disengage the rivet 56 from the associated dimple 58. With the locking assembly 38 released, the tension on the fabric web 12 is relaxed. Next, the leg assemblies 16 can be folded to a closed condition—that is from a generally X-shaped condition to a generally parallel condition. The leg assemblies 16 are folded and the frame rail members 18 are brought laterally towards each other to compress the frame 14 as shown in FIG. 6. As this happens, the fabric web 12 also folds up between the frame rail members 18. The locking assembly 38 also folds to a parallel condition. Once the frame 14 has been fully compressed, the bundling process can continue.

As illustrated in FIG. 7, the user then rotates the outer leg assemblies 16 outward and over the top of the frame 14 along the general paths indicated by arrows A. In one embodiment of the present invention, the rotation of the outer leg assemblies 16 relative to the frame 14 causes the end loops 30 of the fabric web 12 to be automatically removed from the ends of the frame rail members 18. Typically, the user manually removes the end loops 30 from the ends of the frame rail members 18 after the locking assembly 38 has been unlocked and the fabric web 12 has been relaxed at least a bit. The outer leg assemblies 16 end up in parallel relation to the frame rail members 18. Then, the user pivots the frame rail members 18 downwardly along the paths indicated by arrows B to positions parallel to and on either side of the central leg assembly 16, as shown in FIG. 8. The cot structure 10 has been fully collapsed into a compact bundle.

To set up the cot structure 10, the above-described steps can be reversed. First, the frame rail members 18 and outer leg assemblies 16 are folded out from the central leg assembly 16. Then, the outer leg assemblies 16 are rotated downwardly and inwardly to positions beneath the frame 14. The leg assemblies 16 are unfolded, generally by pulling the frame rail members 18 laterally away from one another. The fabric end loops 30 are positioned around the ends of the frame rail members 18 to tighten the fabric web 12 at each end. The end loops 30 can be placed in position either before or after the leg assemblies 16 are unfolded. If the end loops 30 are properly positioned during the set-up operation, the ends of the frame rail members 18 can catch the loops 30 as the outer leg assemblies 16 are being rotated away from the frame 14 and the fabric web 12 can consequently take a taut form upon unfolding the leg assemblies 16 to the open condition. Lastly, the locking assemblies 38 are locked by applying a force on the first pedals 52 on each locking assembly 38, preferably by stepping downward on each first pedal 52, until the rivet 56 engages the dimple 58 so that the locking assembly 38 does not disengage or unlock absent a requisite force applied to the second pedal 54.

Though the preferred means of locking the locking assembly 38 is using the first pedal 52 and the preferred means of unlocking the locking assembly 38 is using the second pedal 54, and more particularly, by applying a downward force to the pedals 52 and 54 using one's foot or hand, alternate means of locking and unlocking the locking assembly 38 may be used without departing from the principles and spirit of the present invention. For example, the first pedal 52 can be used for both locking and unlocking the locking assembly 38. That is, a force is applied to the first pedal 52 in one direction to lock the locking assembly 38, while a force in the opposite direction can be applied to the first pedal 52 to unlock the locking assembly. This action may be preferred where the user is standing to the side of the cot 10, where the extension 50 is easily accessible. Similarly, the user can use just the second pedal 54, typically located between the legs 20 and 22 of the leg assembly 16 to both lock and unlock the locking assembly 38. This action may be preferred where the user is standing at the end of cot 10.

Further, as noted, the locking assembly 38 can be designed so that a downward force is applied to the first pedal 52 to lock the locking assembly 38, and a downward force is applied to the second pedal 54 to unlock the locking assembly. Alternatively, the locking assembly 38 can be designed so that an upward force is applied to the first pedal 52 to lock the locking assembly, and an upward force is applied to the second pedal 54 to unlock the locking assembly 38.

Figure 5:
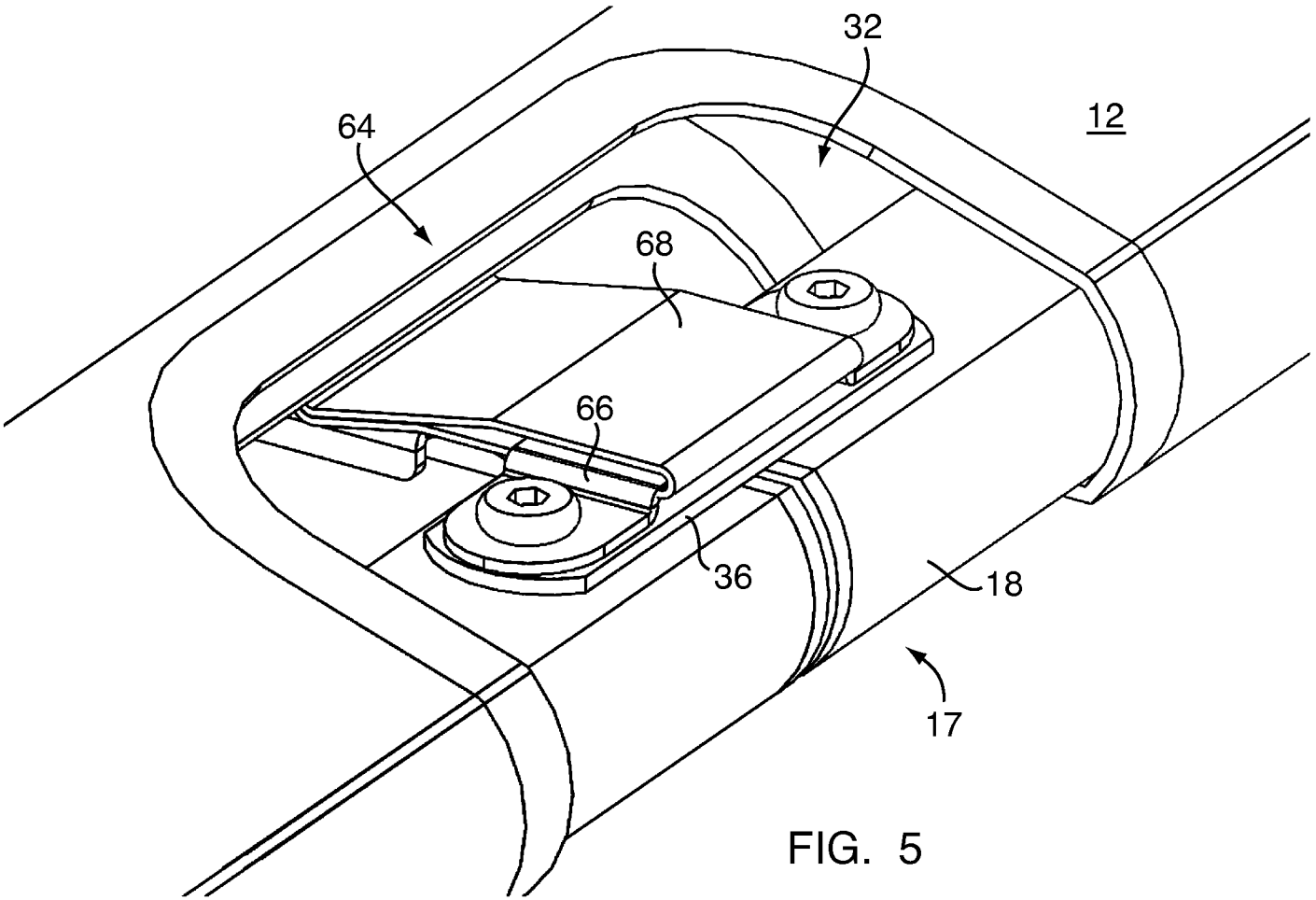
FIG. 5 is a partial perspective view of an anchor assembly used with the cot structure of FIG. 1 in accordance with the present invention.

Referring to FIG. 5, an anti-sag anchor assembly, generally designated as reference numeral 64, is illustrated. The anchor assembly 64 is provided to minimize sagging of the fabric web 12 in the longitudinal center of the cot structure 10. Additionally, the anchor assembly 64 longitudinally centers the fabric web 12 on the frame 14 and prevents it from shifting towards either end when a weight is applied on the fabric 12. As shown, an anchor bracket 66 is mounted on the T-bracket 36 attached to the inside surface of each rail member 18. A corresponding fabric strip 68 is attached to the fabric web 12, preferably on each side of the fabric 12 at its longitudinal center. Each strip 68 is attached to a corresponding anchor bracket 66 to secure the fabric 12 into place and to restrict sagging of the fabric 12 in the proximity of the anchor assembly 64. As shown, each strip 68 is stitched to the fabric web 12 at one end, and comprises a loop at the other end that loops around the anchor bracket 66. Alternatively, each strip 68 can be secured to an associated anchor using a known fastening means, such as a hook-and-loop fastener, a snap, a buckle, or the like.

When the cot 10 is in its set-up condition, as shown in FIG. 1, the lateral separation of the frame rail members 18 pulls the fabric strips 68 outwardly to tighten the fabric web 12, which provides adequate support for a person laying down or sitting on the cot 10, and prevents sagging of the fabric 12 when such a weight is applied to the fabric 12. If a greater weight is applied on one or the other end of the fabric 12, the anchor assembly 64 keeps the fabric 12 in position and prevents it from being pulled or shifted toward the weight. The longitudinal center of the fabric web 12, and indeed other portions of the web as well, can be further strengthened by stitching across the web 12. In a preferred embodiment, such stitching in combination with the anchor assembly 64 and the end loops 30 at the longitudinal ends of the fabric web 12 provide sufficient tautness and restrict undesirable sagging so as to increase the comfort of the cot structure 10 for a user in comparison with prior art cot designs.

Though shown as open "loops" in FIG. 1, the end loops 30 can have a variety of forms without detracting from their intended function for the cot structure 10 of the present invention. That is, the end loops 30 are generally provided at the longitudinal ends of the fabric web 12 to add tension at the ends of the cot structure 10 and counteract any side-to-side and head-to-toe sagging that may occur when a person is laying or sitting on the cot structure 10. For example, the end loops 30 can comprise closed loops that slip or loop over the ends of the frame rail members 18. Alternatively, the longitudinal ends of the fabric web 12 can include a lengthwise pocket sewn into the web 12 that slips or loops over the ends of the frame rail members 18. Further, the end loops 30 can take the form of sleeves sewn into the fabric web 12 whereby the web 12 has a clean look when viewed from above, with no visible discontinuity in the fabric at the corners of the web 12. Still further, the end loops 30 can comprise strips that can be looped around the frame rail members 18 and secured into place to maintain the tautness of the fabric web 12—e.g., by known fastening means, such as a hook-and-loop fastener, a snap, a buckle, or the like. Still further, the end loops 30 can comprise combinations of these various designs, including a closed loop on one side that is put into place over its respective frame rail member 18 first, and an open loop on the opposite side that is put into place on its respective frame rail member 18 to tension the fabric web 12.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A portable and collapsible cot comprising:

a frame including a pair of rail members;

a fabric web provided on the frame and extending between the rail members thereof;

a plurality of foldable leg assemblies, each leg assembly being pivotally connected to the frame, wherein each leg assembly further comprises a first leg and a second leg pivotally connected together, said leg assembly being movable between an open condition and a closed condition wherein when in said open condition, the first and second legs are disposed in a generally X-shaped relationship, and wherein when in said closed condition, the first and second legs are disposed in a generally parallel relationship; and a locking assembly pivotally mounted to at least one leg assembly for locking the cot in an open condition, wherein said locking assembly comprises:

a first portion pivotally connected to the first leg of the leg assembly to which said locking assembly is mounted, said first portion including an extension formed on an end of the first portion outwardly extending from the pivotal connection point between the first portion and the first leg, a first pedal mounted on the extension, and a second portion pivotally connected to the second leg of said leg assembly, wherein the first and second portion are further pivotally connected to one another and moveable between a locked condition and an unlocked condition, and wherein a force applied to the first pedal moves the locking assembly to and from its locked condition;

wherein said open condition of the leg assemblies is associated with the open condition of the cot such that the rail members of the frame are spaced apart from one another and the fabric web is generally taut therebetween when the leg assemblies are in the open condition, and wherein further the rail members of the frame are generally abutting one another and the fabric web is generally relaxed when the leg assemblies are in the closed condition.

2. The cot according to claim 1, wherein a downward force is applied to the first pedal to move the locking assembly to its locked condition and an upward force is applied to the first pedal to move the locking assembly from its locked condition.

3. The cot according to claim 1, wherein the locking assembly further includes a second pedal, wherein a force applied to said second pedal unlocks the locking assembly from its locked condition.

4. The cot according to claim 3, wherein a downward force is applied to the second pedal to move the locking assembly from its locked condition and an upward force is applied to the second pedal to move the locking assembly to its locked condition.

5. The cot according to claim 3, wherein the second pedal is mounted on the first portion of the locking assembly on the inward end thereof at a position proximate the pivotal connection point between the first portion and the second portion of the locking assembly.

6. The cot according to claim 1, further comprising an anchor assembly connected between the frame and the fabric web for restricting sag of the fabric web between the frame rail members in the open condition of the cot.

7. A portable and collapsible cot comprising:

a frame including a pair of rail members;

a fabric web provided on the frame and extending between the rail members thereof;

an anchor assembly connected between the frame and the fabric web for restricting sag of the fabric web between the frame rail members in an open condition of the cot, wherein the anchor system comprises an anchor bracket mounted on each rail member and fabric strips attached at a first end to the fabric web and at a second end to a respective anchor bracket for connecting the fabric web to the frame of the cot structure;

a plurality of foldable leg assemblies, each leg assembly being pivotally connected to the frame, wherein each leg assembly further comprises a first leg and a second leg pivotally connected together, said leg assembly being movable between the open condition and a closed condition wherein when in said open condition, the first and second legs are disposed in a generally X-shaped relationship, and wherein when in said closed condition, the first and second legs are disposed in a generally parallel relationship; and a locking assembly pivotally mounted to at least one leg assembly for locking the cot in an open condition;

wherein said open condition of the leg assemblies is associated with the open condition of the cot such that the rail members of the frame are spaced apart from one another and the fabric web is generally taut therebetween when the leg assemblies are in the open condition, and wherein further the rail members of the frame are generally abutting one another and the fabric web is generally relaxed when the leg assemblies are in the closed condition.

8. The cot according to claim 7, wherein the fabric strips are positioned on each side of the fabric web at the longitudinal center thereof.

9. A portable and collapsible cot comprising:

a frame including a pair of rail members;

a fabric web provided on the frame and extending between the rail members thereof;

an anchor assembly connected between the frame and the fabric web for restricting sag of the fabric web between the frame rail members in an open condition of the cot, end loops attached to the longitudinal ends of the fabric web that are positioned around the extreme ends of the frame rail members;

a plurality of foldable leg assemblies, each leg assembly being pivotally connected to the frame, wherein each leg assembly further comprises a first leg and a second leg pivotally connected together, said leg assembly being movable between an open condition and a closed condition wherein when in said open condition, the first and second legs are disposed in a generally X-shaped relationship, and wherein when in said closed condition, the first and second legs are disposed in a generally parallel relationship; and a locking assembly pivotally mounted to at least one leg assembly for locking the cot in an open condition;

wherein said open condition of the leg assemblies is associated with the open condition of the cot such that the rail members of the frame are spaced apart from one another and the fabric web is generally taut therebetween when the leg assemblies are in the open condition, and wherein further the rail members of the frame are generally abutting one another and the fabric web is generally relaxed when the leg assemblies are in the closed condition.

10. The cot according to claim 1 comprising an end foldable leg assembly pivotally connected at each longitudinal end of the frame rail members via pivotable reverse L-shaped brackets, and a center foldable leg assembly connected to the longitudinal center of the frame rail members via a pivotable T-shaped brackets.

11. A cot comprising:

a frame including a pair of rail members supported by a plurality of leg assemblies;

an end foldable leg assembly pivotally connected at each longitudinal end of the frame rail members via pivotable reverse L-shaped brackets, a center foldable leg assembly connected to the longitudinal center of the frame rail members via a pivotable T-shaped brackets, a fabric web provided on the frame and extending between the rail members thereof; and at least one anchor assembly connecting the fabric web to the frame for restricting sag of the fabric between the rail members;

wherein said at least one anchor assembly comprises an anchor bracket mounted on a respective T-shaped bracket that is connected to an inside surface of each frame rail member and a corresponding fabric strip that loops around the anchor bracket to connect the fabric web to the frame of the cot structure.

12. A portable and collapsible cot comprising:

a frame including a pair of rail members;

a fabric web provided on the frame and extending between the rail members thereof;

a plurality of foldable leg assemblies, each leg assembly being pivotally connected to the frame, wherein each leg assembly further comprises a first leg and a second leg pivotally connected together, said leg assembly being movable between an open condition and a closed condition wherein when in said open condition, the first and second legs are disposed in a generally X-shaped relationship, and wherein when in said closed condition, the first and second legs are disposed in a generally parallel relationship; and a locking assembly pivotally mounted to at least one leg assembly for locking the cot in an open condition, wherein said locking assembly comprises:

a first portion pivotally connected to the first leg of the leg assembly to which said locking assembly is mounted, a second portion pivotally connected to the second leg of said leg assembly, wherein the first and second portion are further pivotally connected to one another and moveable between a locked condition and an unlocked condition, a first pedal, wherein a force applied to the first pedal moves the locking assembly to and from its locked condition, and a second pedal, wherein a downward force is applied to said second pedal to move the locking assembly from its locked condition and an upward force is applied to the second pedal to move the locking assembly to its locked condition;

wherein said open condition of the leg assemblies is associated with the open condition of the cot such that the rail members of the frame are spaced apart from one another and the fabric web is generally taut therebetween when the leg assemblies are in the open condition, and wherein further the rail members of the frame are generally abutting one another and the fabric web is generally relaxed when the leg assemblies are in the closed condition.

13. The cot according to claim 12, wherein a downward force is applied to the first pedal to move the locking assembly to its locked condition and an upward force is applied to the first pedal to move the locking assembly from its locked condition.

14. The cot according to claim 12, wherein the first portion includes an extension formed on an end of the first portion outwardly extending from the pivotal connection point between the first portion and the first leg, wherein the first pedal is provided on the extension.

15. The cot according to claim 14, wherein the second pedal is mounted on the first portion of the locking assembly on the inward end thereof at a position proximate the pivotal connection point between the first portion and the second portion of the locking assembly.

16. The cot according to claim 12, further comprising an anchor assembly connected between the frame and the fabric web for restricting sag of the fabric web between the frame rail members in the open condition of the cot.

17. The cot according to claim 16, wherein the anchor system comprises an anchor bracket mounted on each rail member and fabric strips attached at a first end to the fabric web and at a second end to a respective anchor bracket for connecting the fabric web to the frame of the cot structure.

18. The cot according to claim 12 comprising an end foldable leg assembly pivotally connected at each longitudinal end of the frame rail members via pivotable reverse L-shaped brackets, and a center foldable leg assembly connected to the longitudinal center of the frame rail members via a pivotable T-shaped brackets.

* * * * *